US006099225A

United States Patent [19]

Allen et al.

[11] Patent Number: 6,099,225

[45] Date of Patent: Aug. 8, 2000

[54] BOOKLET MAKER

[75] Inventors: Ross R. Allen, Belmont; Steven W. Trovinger, Los Altos, both of Calif.

[73] Assignee: Hewlett-Packard Company, Palo Alto, Calif.

[21] Appl. No.: 09/162,844

[22] Filed: Sep. 29, 1998

[51] Int. Cl.[7] ..... B42C 1/00; B26D 5/20; B42B 4/02; B27F 7/17

[52] U.S. Cl. ..... 412/32; 412/1; 412/3; 412/4; 412/6; 412/18; 412/19; 412/20; 412/21; 412/22; 412/23; 412/24; 412/16

[58] Field of Search ..... 412/1, 3, 4, 6, 412/18–24, 16

[56] References Cited

U.S. PATENT DOCUMENTS

| | | | |
|---|---|---|---|
| 4,484,501 | 11/1984 | Ramcke | 412/16 |
| 4,575,296 | 3/1986 | Kockler et al. | 412/6 |
| 4,795,071 | 1/1989 | Jacobs et al. | 412/6 |
| 5,632,587 | 5/1997 | Coyette | 412/4 |

OTHER PUBLICATIONS

European Search Report, Application No. EP 99 30 7586, dated Jan. 12, 2000.

Berger, P.; "Investieren Mit Blick Auf Digitals Nischenprodukete" Deutscher Drucker, De, Deutscher Drucker Verlagsgesellschaft, Ostfildern; Vol. 34, No. 35, p. W45, W48 XP000783487; ISSN: 0012–1096.

*Primary Examiner*—Andrea L. Pitts
*Assistant Examiner*—Mark T. Henderson

[57] ABSTRACT

A low cost, high speed, high resolution laser printer method and apparatus for re-writable media is presented. A method for finishing of printed sheets into booklets is described. Novel mechanical operations permit the manufacture of a very low-cost, off-line booklet maker for use with desktop laser and ink jet printers. The technology can scale to medium-speed, in-line booklet manufacture. The method is novel because most of the finishing operations are performed on a sheet-by-sheet basis using precision paper positioning and a transverse tool carrier that cuts, scores, folds, punches, and staples the sheets. To form a finished saddle-stitched booklet, each sheet is cut to length determined by its sequence in the booklet and paper thickness, scored, punched (if required), folded, accumulated in a stack, and stapled. The sheet-wise method allows finishing operations to be done with low-cost tools and low actuation forces.

25 Claims, 5 Drawing Sheets

SADDLE-STITCHED BOOKLET:

- BINDING EQUAL-WIDTH SHEETS PRODUCE A CHAMFERED EDGE
- TRIM REQUIRED TO PRODUCE A FLAT EDGE

- AFTER TRIM

BOOKLET MAKER

BACKGROUND OF THE INVENTION

1. Field of the Invention

The present invention relates to electronic publishing and, more particularly, to the finishing of printed sheets into booklets.

2. Description of the Related Art

Electronic publishing demands more than a stack of paper in an output tray of a laser or ink jet printer. Typically, many sheets, duplex printed, must be bound into finished documents by a paper-handling accessory. Currently, machines exist to perform operations such as perfect binding, folding, trimming, saddle stapling, and hole drilling. These finishing operations are typically performed on many sheets at a time, requiring high forces and powerful motors. Such machines are expensive, $2,000–$10,000 depending on function, and often exceed the cost of desktop or office printers. As such, they are not well-suited to low-cost desktop finishing.

The demands of electronic and desktop publishing are driving the need for a compact, low-cost, high-quality, and low- to medium-speed finishing machine suitable for use with desktop laser and ink jet printers. Prior art solutions to making booklets typically involve machines costing $4000 or more for simple functions such as folding and stapling. They are bulky and require a long paper path to implement sequential finishing operations. Trimming and punching are performed on the assembled booklet, and this requires a cutter and power source capable of processing 20 to 50 sheets at one time.

Thus, it can be seen that current finishing techniques impose size, cost and power limits upon booklet making devices, and hinder the use of these devices in many applications.

Therefore, there is an unresolved need for a finishing technique that permits one to make booklets using a low-power device which is inexpensive and compact.

SUMMARY OF THE INVENTION

A low cost, low power method and compact apparatus for finishing of printed sheets into booklets is described. Novel mechanical operations permit the manufacture of a very low-cost, off-line booklet maker for use with desktop laser and ink jet printers. The technology can scale to medium-speed, in-line booklet manufacture. The method is novel because most of the finishing operations are performed on a sheet-by-sheet basis using precision paper positioning and a transverse tool carrier that cuts, scores, folds, punches, and staples the sheets. To form a finished saddle-stitched booklet, each sheet is cut to length determined by its sequence in the booklet and paper thickness, scored, punched (if required), folded, accumulated in a stack, and stapled. The sheet-wise method allows finishing operations to be done with low-cost tools and low actuation forces.

This invention eliminates the cost and bulk of finishing operations while allowing more operations to be done in a compact, low-cost machine. The use of sheet-wise operations reduces the power and bulk requirements of the finisher allowing operations to be controlled with low-cost DC servomotors and solenoids. The use of precision X-Y position control leverages pen-plotter and printer engineering expertise in sheet-wise paper handling. The booklet maker described herein concentrates finishing operations into a single module suitable for off-line and on-line processing.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Embodiments of the invention are discussed below with reference to FIGS. 1–5. Those skilled in the art will readily appreciate that the detailed description given herein with respect to these figures is for explanatory purposes, however, because the invention extends beyond these limited embodiments.

Figure 1:
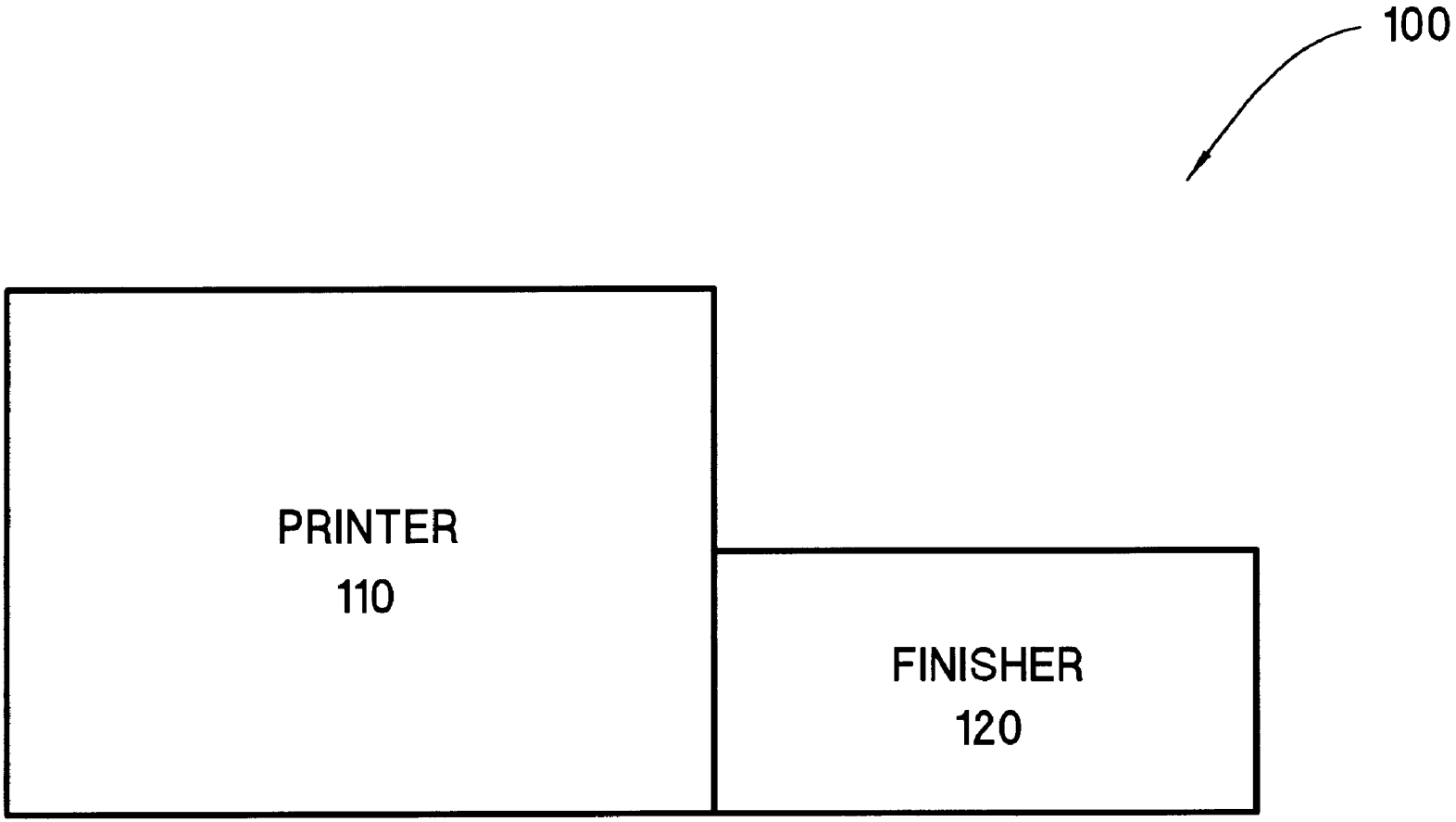
FIG. 1 is a diagram illustrating a printer and binding finisher system suitable for use as a booklet maker according to the present invention.

FIG. 1 is a diagram illustrating a printer 110 and binding finisher 120 system suitable for use as a booklet maker 100 according to the present invention. There is a significant business opportunity for a low-cost booklet maker producing finished documents in the electronic publishing environment. The present invention incorporates novel electromechanical processes to reduce cost, size, and power requirements for finishing operations. This is accomplished with novel operations executed on a per-sheet basis using sensors and embedded intelligence, rather than bulk processes (e.g., cutting and trimming) typically performed on 10's to 1000's of sheets at one time. This approach facilitates small, inexpensive and compact solutions suitable to the desktop and well-matched in performance and cost to office ink jet and laser printers.

Figure 2:
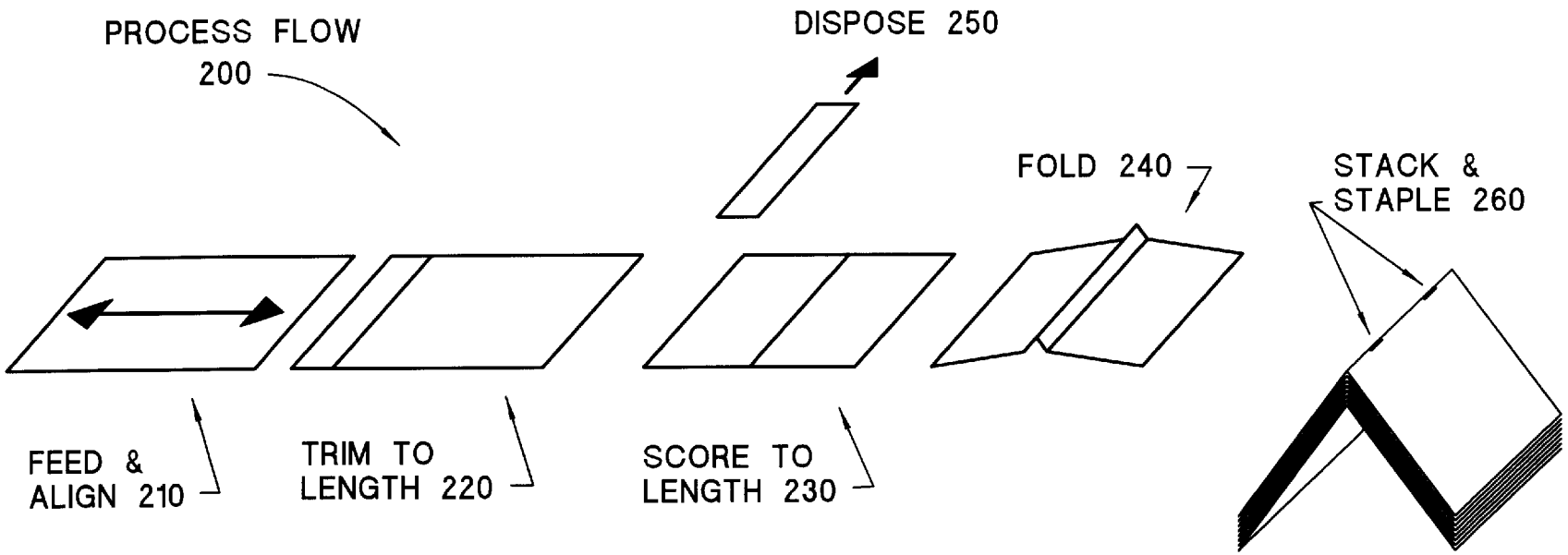
FIG. 2 is a diagram illustrating process flow according to an embodiment of the present invention.

FIG. 2 illustrates process flow according to an embodiment of the present invention. For this embodiment, the process flow 200 begins with the feeding and alignment 210 of a printed sheet. The present invention breaks the paradigm for booklet making. Operations such as trimming 220, scoring 230, folding 240, and hole-drilling (not shown) are performed on each sheet. Although trimming to length is shown in the diagram, trimming to width can also be done. In either event, the trimmed portions are ejected for disposal 250. The sheets are then assembled by stacking into a booklet, stapled 260, and delivered to an output tray. Fundamental differences distinguish this invention from previous finishing approaches.

Figure 3A:
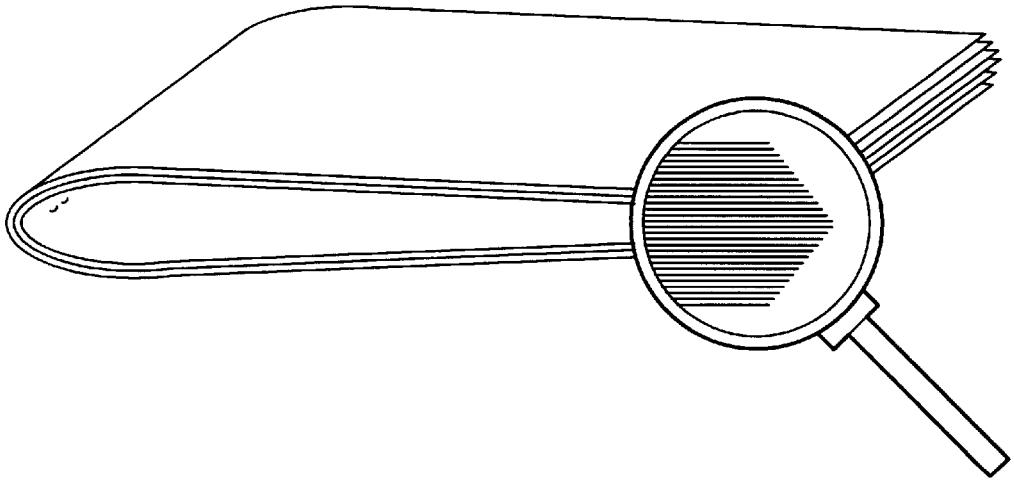
FIG. 3A is a diagram illustrating a saddle-stitched booklet having a chamfered edge.
Figure 3B:
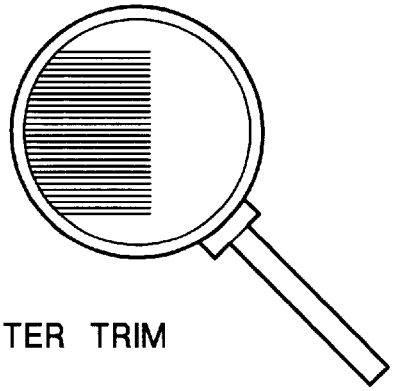
FIG. 3B is a diagram illustrating a saddle-stitched booklet having an even edge.

For example, consider a saddle-stitched booklet as shown in FIG. 3A. In typical finishing processes, sheets of equal dimension are assembled in a stack, stapled, folded, and finally trimmed to produce an even edge. Because outer sheets wrap around inner sheets, simply assembling the booklet and stapling produces a chamfered edge with the inner sheets sticking out and the outer sheets (and cover) appearing to be shorter. The enlargement of FIG. 3A illustrates the chamfered edge. Traditionally, the entire booklet is trimmed inboard of the edge of the cover (i.e., the shortest sheet because of the longest wrap length) to produce an even edge (shown in FIG. 3B).

In the present invention, each sheet is precision-trimmed individually to a prescribed length depending on paper thickness and its position in the booklet: the innermost sheet is shortest and the outermost sheet, the cover, is the longest. Each sheet is similarly scored in a different position from one edge creating a fold line in the center of each sheet. Implementing such operations requires the ability to load, align, register, and position paper repeatably to about 0.001" between sheets. Hewlett-Packard Company ("HP") has developed this expertise over many years with gritwheel pen plotters and ink jet printers. When the sheets are assembled, registered on the fold line, and stapled together, a finished booklet is produced with an even edge.

The invention incorporates additional novelty to reduce cost and add flexibility to the finishing operations: precision motion along the paper feed axis locates each sheet for an operation; trim, score, punch, and staple operations are performed by a toolset moved transverse to the sheet feed direction on a tool carrier. This unique approach minimizes the forces and power required to perform finishing operations and allows production of a lightweight, inexpensive mechanism employing small DC servomotors, stepping motors, and solenoids.

DESCRIPTION OF THE INVENTION

The following points describe several features of our invention:

Finishing operations, except for final binding, are performed one sheet at a time. This is a primary element of novelty in this invention. Conventional booklet making operations, particularly trimming and punching, typically operate on the entire set of bound sheets.

Figure 4:
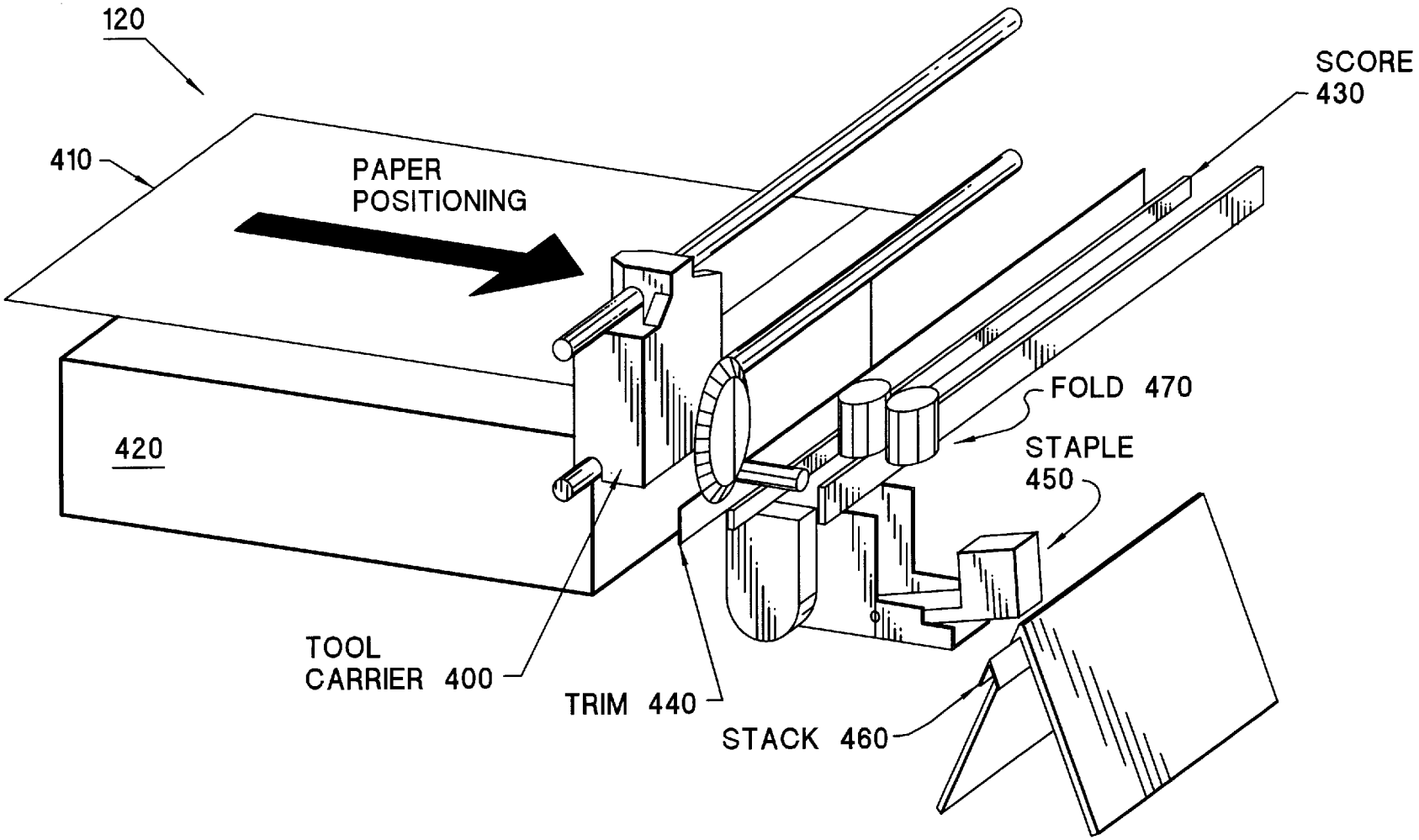
FIG. 4 is a diagram illustrating an embodiment of a saddle-stitched binder according to the present invention.

FIG. 4 illustrates an embodiment of a saddle-stitch binding finisher 120 according to the present invention. Sheet 410 is fed into a station 420 where a plurality of finishing operations (i.e., trim, score, punch, fold, and staple) are performed by a tool carrier 400 that moves transversely across the sheet (Y-direction) in a direction perpendicular to paper feed (X-direction). The position of the sheet 410 and the tool carrier 400 are precisely controlled and coordinated to accomplish the finishing operations.

The tool carrier 400 individually or in combination carries a single sheet cutter 450, sheet-scoring tool (for folding) 430, punch (not shown), trim-waste grabber, and stapler 450 across the page to perform sheet-wise finishing operations.

For one embodiment, the same Y-axis servo is used for multiple finishing operations to position individual tools or tools working in combination. Alternately, more than one Y-axis servo can be used.

Operations performed sheet-wise minimize need for mechanisms subjected to high forces and with high power requirements.

For one embodiment, these operations are to:

CUT each sheet individually,

SCORE each sheet individually,

PUNCH each sheet individually, and partially FOLD each sheet individually.

The score and/or fold operation on individual sheets provides a registration feature to align each sheet to the rest of the booklet. The use of the fold as a registration feature is an important aspect of the invention because conventional alignment based upon an edge will not work due to the differences in page length and fold position.

A workpiece 460 shaped like an inverted or normal "V" collects sheets and aligns them for stapling. A friction or vibrating mechanism, or a push bar, assures alignment to a Y-axis stop. As shown in FIG. 4, the inverted "V" permits alignment to be accomplished using gravity by hanging the sheets across workpiece 460. On the other hand, an advantage of having a normal "V"-shaped workpiece is that the booklet can be assembled towards the inside from the outside cover. Thus, one need not know how many pages the booklet has prior to beginning the finishing process. For one embodiment, workpiece 460 can also be used as part of an ejection mechanism for delivering the completed booklet to an output tray.

For one embodiment, alignment of each sheet involves:

1. feeding the sheet into the mechanism;
2. aligning the sheet to a Y-axis stop; and
3. positioning the sheet in the X-axis with respect to a paper edge sensor and moving the sheet precisely with respect to this position in subsequent operations.

The paper edge sensor can be an optoelectronic sensor of a type known in the art where the presence of media interrupts a reflected beam of light, and the signal can be processed into a precision measurement of sheet position. The paper edge sensor can also be used to read a barcode printed on a job ticket to provide instructions to the finisher.

Figure 5:
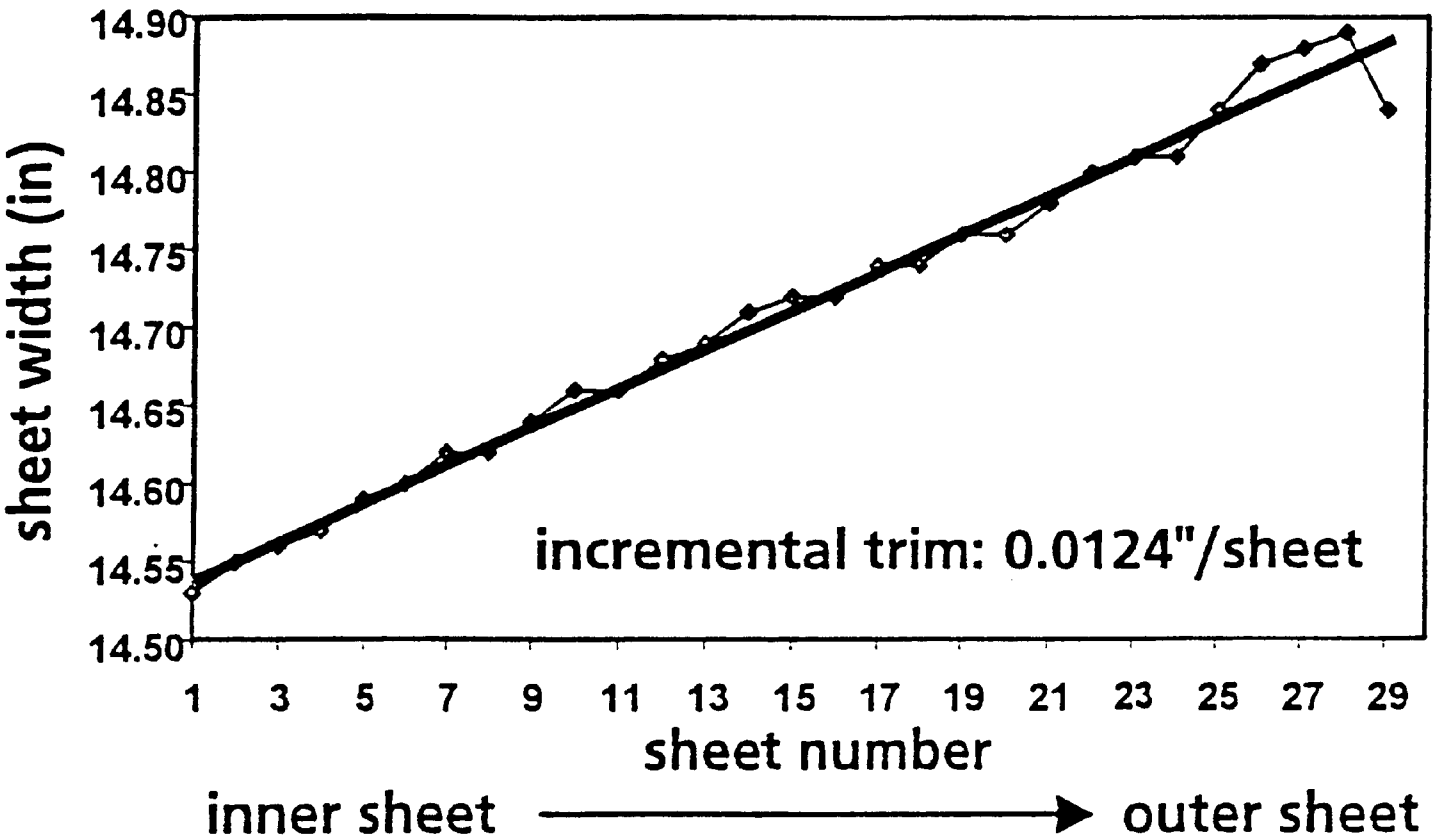
FIG. 5 is a diagram illustrating an example of a trim schedule for media according to an embodiment of the present invention.

When assembled into a saddle-stitched booklet, each sheet has a different finished dimension (i.e., the page width in the assembled booklet) due to the effect of outer sheets wrapping over inner ones. In this invention, each sheet is trimmed to a unique and precise length and the fold line established so that the edge of the assembled booklet is flat as if all sheets had been trimmed together to final size. The trimming operation cuts only one edge of individual sheets to vary the page width—there is no need to cut both edges of sheet, and the entire book does not need to be trimmed to produce a flat edge after sheets are folded and stapled. This is a major element of uniqueness and novelty in this invention. The sheet width is determined by an algorithm and is a function of the page number and thickness of the paper. FIG. 5 illustrates an example of a trim schedule for media (approximately 0.00325 inch thick) according to an embodiment of the present invention.

The number of sheets in the booklet and other job and media parameters can be specified electronically, through a network connection, a front panel, or by using a machine-readable job ticket.

The number of pages in the booklet need not be specified in advance if the booklet is made with the cover as the first sheet and additional sheets follow the cover through the finishing operation. In this case, the trim schedule can be made a function of page count (and media thickness) until another cover sheet or job separator is encountered.

Software adjusts the location of printed images on each sheet with respect to a fixed edge. The position will vary sheet-wise and depend on the page number in the booklet. For one embodiment, this is handled automatically in the printer driver when the booklet making option is selected.

It is possible to measure individual sheet thickness sheet-by-sheet within the booklet and adjust the trim algorithm accordingly based on the accumulated number of sheets and their thickness. This allows for variation in page thickness within booklet, such as card stock for different chapters, etc. Thickness information on a sheet-by-sheet basis can be made by measurement as each sheet is processed. Alternatively, a sheet thickness specification may be included as data in an electronic or machine-readable job ticket.

A plurality of staple forming tools (i.e., anvils) are arranged at multiple fixed positions along the fold line of sheets and a staple head moves across the stack into registration with these tools one at a time to staple the stacked and partially-folded sheets into a booklet.

Multiple staple heads (and anvils) may be used to staple the stacked and partially-folded sheets into a booklet.

The finishing tools (e.g., trimmer, punch, score and fold (470 of FIG. 4) tools, and stapler) may move with the tool carrier and be selected one or more at a time, or may be parked out of the paper path and clutched onto the carrier to perform their function.

Cut and score tools may be left at either end of the tool carrier travel so as to avoid retracing tool path to put tool away. This increases throughput by eliminating extra tool movement. For example, the motion would be . . .

Sheet 1: Cut (left to right)—Score (right to left)

Sheet 2: Score (left to right)—Cut (right to left)

Sheet 3: etc.

A friction device attached to tool carrier accomplishes ejection of waste paper strips from the trim operation. Strips are moved off to the side and ejected into separate container by action of cut sheet being moved to fold position. Alternatively, cut strips may be discharged into a slot near the cutting tool using mechanical or vacuum assistance or a combination thereof.

Saddle-stitched booklets frequently exhibit an effect called "pillowing," where the fold is indistinct and the booklet does not lie flat. Scoring and folding each sheet achieves a significant reduction of pillowing compared to folding of the bound stack after stapling.

The many features and advantages of the invention are apparent from the written description and thus it is intended by the appended claims to cover all such features and advantages of the invention. Further, because numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A finisher for saddle-stitch booklets, the finisher comprising:

a positioning mechanism adapted to position sheets to a prescribed position longitudinally in a sheet feed direction;

a tool carrier adapted to move traversly to the sheet feed direction;

a tool adapted to be carried by the tool carrier and, operating on a sheet-by-sheet basis, the tool operating on a prescribed longitudinal and traverse position on a sheet of paper according to position of the sheet within the booklet; and a scoring tool carried by the tool carrier, the scoring tool adapted to score each sheet along a line where the sheet will be folded and bound into the booklet.

2. The finisher as set forth in 1, comprising a cutter tool adapted to cut sheets, the cutter tool carried by the tool carrier and, operating on a sheet-by-sheet basis, the cutter tool precision trimming each sheet to a prescribed length according to position within the booklet.

3. The finisher as set forth in 1, comprising a grabber tool carried by the tool carrier, the grabber tool adapted to grab trim waste.

4. The finisher as set forth in 1, comprising a folding tool carried by the tool carrier, the folding tool adapted to fold each sheet along a line where the sheet will be bound into the booklet.

5. The finisher as set forth in 1, comprising a punch tool carried by the tool carrier, the punch tool adapted to punch holes in individual sheets.

6. The finisher as set forth in 1, comprising a stapling tool carried by the tool carrier, the stapling tool adapted to staple the individual sheets together to form the booklet.

7. The finisher as set forth in 1, comprising a work piece adapted to collect sheets and to align the sheets for stapling.

8. The finisher as set forth in 7, comprising a stapling tool carried by the tool carrier, the stapling tool adapted to staple the individual sheets together to form the booklet.

9. The finisher as set forth in 1, wherein the cutter tool is adapted to cut sheets to a prescribed width.

10. A booklet maker for making saddle-stitched booklets, the booklet maker comprising:

a printer to print sheets for the booklet; and a finisher as set forth in claim 1 adapted to receive and finish sheets printed by the printer.

11. A finishing method for saddle-stitch booklets, the finishing method comprising:

positioning sheets to a prescribed position longitudinally in a sheet feed direction;

moving a tool carrier traversly to the sheet feed direction;

operating on a sheet-by-sheet basis, using a tool carried by the tool carrier to operate on a prescribed longitudinal and transverse position on a sheet of paper according to position of the sheet within the booklet; and using a scoring tool carried by the tool carrier to score each sheet along a line where the sheet will be bound into the booklet.

12. The finishing method as set forth in 11 comprising using a cutter tool carried by the tool carrier to precision trim each sheet to a prescribed length according to position within the booklet.

13. The finishing method as set forth in 11, comprising using a grabber tool carried by the tool carrier to grab trim waste.

14. The finishing method as set forth in 11, comprising using a folding tool carried by the tool carrier to fold each sheet along a line where the sheet will be bound into the booklet.

15. The finishing method as set forth in 11, comprising using a punch tool carried by the tool carrier to punch holes in individual sheets.

16. The finishing method as set forth in 11, comprising using a stapling tool carried by the tool carrier to staple the individual sheets together to form the booklet.

17. The finishing method as set forth in 11, comprising using a work piece to collect sheets and to align the sheets for stapling.

18. The finishing method as set forth in 17, comprising using a stapling tool carried by the tool to staple the individual sheets together to form the booklet.

19. The finishing method as set forth in 11, comprising using the cutter tool to cut sheets to a prescribed width.

20. A booklet making method for making saddle-stitched booklets, the booklet maker comprising:

printing sheets for the booklet; and receiving and finishing the printed sheets using the method as set forth in claim 11.

21. A finishing method for saddle-stitch booklets, the method comprising:

folding sheets of the booklet along a line where the sheets will be bound, the sheets being precision cut to length on a sheet-by-sheet basis depending upon position within the booklet; and using the fold of each of the sheets as a registration feature to align each sheet to the rest of the booklet.

22. A finisher for saddle-stitch booklets, the finisher comprising:

a positioning mechanism adapted to position sheets to a prescribed position longitudinally in a sheet feed direction;

a tool carrier adapted to move traversly to the sheet feed direction;

a tool adapted to be carried by the tool carrier and, operating on a sheet-by-sheet basis, the tool operating on a prescribed longitudinal and traverse position on a sheet of paper according to position of the sheet within the booklet; and a grabber tool carried by the tool carrier, the grabber tool adapted to grab trim waste.

23. A finisher for saddle-stitch booklets, the finisher comprising:

a positioning mechanism adapted to position sheets to a prescribed position longitudinally in a sheet feed direction;

a tool carrier adapted to move traversly to the sheet feed direction;

a tool adapted to be carried by the tool carrier and, operating on a sheet-by-sheet basis, the tool operating on a prescribed longitudinal and traverse position on a sheet of paper according to position of the sheet within the booklet; and a folding tool carried by the tool carrier, the folding tool adapted to fold each sheet along a line where the sheet will be bound into the booklet.

24. A finishing method for saddle-stitch booklets, the finishing method comprising:

positioning sheets to a prescribed position longitudinally in a sheet feed direction;

moving a tool carrier traversly to the sheet feed direction;

operating on a sheet-by-sheet basis, using a tool carried by the tool carrier to operate on a prescribed longitudinal and transverse position on a sheet of paper according to position of the sheet within the booklet; and using a grabber tool carried by the tool carrier to grab trim waste.

25. A finishing method for saddle-stitch booklets, the finishing method comprising:

positioning sheets to a prescribed position longitudinally in a sheet feed direction;

moving a tool carrier traversly to the sheet feed direction;

operating on a sheet-by-sheet basis, using a tool carried by the tool carrier to operate on a prescribed longitudinal and transverse position on a sheet of paper according to position of the sheet within the booklet; and using a folding tool carried by the tool carrier to fold each sheet along a line where the sheet will be bound into the booklet.

* * * * *